US009127673B2

(12) United States Patent
Krampe

(10) Patent No.: US 9,127,673 B2
(45) Date of Patent: Sep. 8, 2015

(54) ROTARY LOBE PUMP HAVING INLET AND OUTLET ALIGNED WITH GEARBOX CASING

(75) Inventor: Paul Krampe, Essen/Olbg (DE)

(73) Assignee: Hugo Vogelsang Maschinenbau GmbH, Essen (DE)

( * ) Notice: Subject to any disclaimer, the term of this patent is extended or adjusted under 35 U.S.C. 154(b) by 53 days.

(21) Appl. No.: 13/816,951

(22) PCT Filed: Aug. 18, 2011

(86) PCT No.: PCT/EP2011/064229

§ 371 (c)(1),
(2), (4) Date: Apr. 22, 2013

(87) PCT Pub. No.: WO2012/022784

PCT Pub. Date: Feb. 23, 2012

(65) Prior Publication Data

US 2013/0202474 A1 Aug. 8, 2013

(30) Foreign Application Priority Data

Aug. 20, 2010 (DE) ..... 20 2010 011 626 U

(51) Int. Cl.
*F04C 2/12* (2006.01)
*F04C 2/08* (2006.01)
(Continued)

(52) U.S. Cl.
CPC . *F04C 2/12* (2013.01); *F04C 2/086* (2013.01); *F04C 2/16* (2013.01); *F04C 11/001* (2013.01);
(Continued)

(58) Field of Classification Search
CPC ..... F04C 2/08; F04C 2/16; F04C 11/00; F04C 15/06; F04C 2230/60; F04C 2230/601; F04C 2230/80; F04C 2230/85; F04C 2240/30; F04C 2/086; F04C 2/12; F04C 2/18; F04C 11/001; F04C 14/02
USPC ..... 418/1, 39, 205, 206.2, 206.4, 206.1, 418/206.7, 70
See application file for complete search history.

(56) References Cited

U.S. PATENT DOCUMENTS 2,096,490 A * 10/1937 Hansen ..... 418/206.7
2,105,428 A * 1/1938 Maglott ..... 277/366
(Continued)

FOREIGN PATENT DOCUMENTS

CN 2348151 Y 11/1999
CN 200946568 Y 9/2007
(Continued)

OTHER PUBLICATIONS

International Search Report dated Mar. 6, 2013 in Application No. PCT/EP2011/064229.
(Continued)

*Primary Examiner* — Thomas Denion
*Assistant Examiner* — Xiaoting Hu
(74) *Attorney, Agent, or Firm* — Kilpatrick Townsend & Stockton LLP; Dean W. Russell, Esq.; Kristin M. Crall, Esq.

(57) ABSTRACT

The invention relates to a rotary lobe pump (100) for conveying a fluid medium containing solids, comprising an inlet opening (111) and an outlet opening (112) for the medium being conveyed, two rotary lobes (121, 122) arranged in a pump casing (140) and having rotary lobe vanes engaging with other, wherein each of the two rotary lobes is fixed torque-resistantly on a respective shaft (131) and can be driven by said respective shaft, and wherein the two shafts are coupled to each other by a transmission gear arranged in a gearbox casing (152). The invention relates in particular to a rotary lobe pump in which the inlet opening and the outlet opening are arranged on a connection casing (151).

14 Claims, 25 Drawing Sheets

Figure 1A:
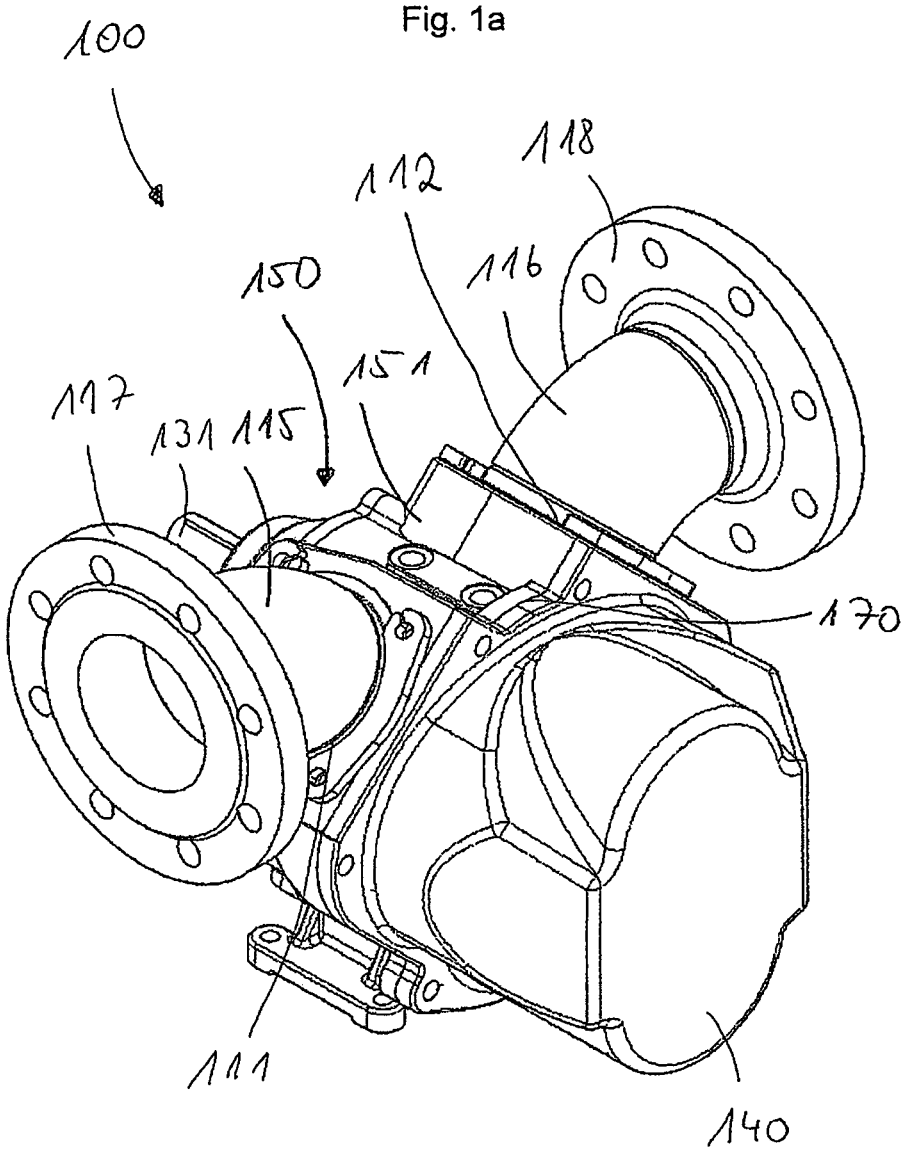

(51) Int. Cl.

| | |
|---|---|
| ***F04C 2/16*** | (2006.01) |
| ***F04C 11/00*** | (2006.01) |
| ***F04C 15/06*** | (2006.01) |
| *F04C 2/18* | (2006.01) |
| *F04C 14/02* | (2006.01) |

(52) U.S. Cl.
CPC . *F04C 15/06* (2013.01); *F04C 2/18* (2013.01); *F04C 14/02* (2013.01); *F04C 2230/60* (2013.01); *F04C 2240/30* (2013.01); *F04C 2240/51* (2013.01); *F04C 2240/801* (2013.01)

(56) References Cited

U.S. PATENT DOCUMENTS

| | | | | |
|---|---|---|---|---|
| 2,338,609 | A * | 1/1944 | Whittaker | 73/201 |
| 3,039,398 | A | 6/1962 | DeMichelis | |
| 3,067,687 | A * | 12/1962 | Husney | 418/39 |
| 3,198,120 | A * | 8/1965 | Little, Jr. | 417/252 |
| 4,017,222 | A | 4/1977 | Ueno et al. | |
| 4,606,712 | A | 8/1986 | Vondra | |
| 5,062,777 | A * | 11/1991 | Carlsson | 418/104 |
| 5,388,974 | A | 2/1995 | Streiff | |
| 5,439,358 | A | 8/1995 | Weinbrecht | |
| 5,468,132 | A | 11/1995 | Snell et al. | |
| 5,567,140 | A | 10/1996 | Dodd | |
| 5,702,240 | A | 12/1997 | O'Neal et al. | |
| 6,062,827 | A * | 5/2000 | Shu | 417/310 |
| 6,095,781 | A * | 8/2000 | Petersen et al. | 418/107 |
| 6,099,277 | A | 8/2000 | Patel et al. | |
| 6,152,719 | A * | 11/2000 | Nelik et al. | 418/201.1 |
| 6,176,693 | B1 | 1/2001 | Conti | |
| 6,203,297 | B1 * | 3/2001 | Patel | 418/15 |
| 6,283,740 | B1 * | 9/2001 | Brown | 418/206.6 |
| 2004/0052670 | A1 * | 3/2004 | Dong | 418/61.3 |
| 2007/0269325 | A1 * | 11/2007 | Candio et al. | 418/9 |
| 2008/0069707 | A1 * | 3/2008 | Van Norman et al. | 417/410.1 |
| 2009/0304540 | A1 * | 12/2009 | Whittome et al. | 418/104 |
| 2011/0052436 | A1 | 3/2011 | Krampe | |
| 2012/0207638 | A1 | 8/2012 | Krampe | |

FOREIGN PATENT DOCUMENTS

| | | | |
|---|---|---|---|
| CN | 101223363 | A | 7/2008 |
| DE | 1553120 | | 4/1970 |
| DE | 2543593 | A1 | 8/1976 |
| DE | 4218855 | A1 | 12/1993 |
| DE | 10239558 | A1 | 3/2004 |
| DE | 102005017575 | A1 | 3/2006 |
| DE | 102007054544 | A1 | 6/2008 |
| DE | 202009009093 | U1 | 11/2009 |
| EP | 1624189 | B1 | 2/2006 |
| EP | 1739306 | A1 | 1/2007 |
| FR | 1492841 | | 8/1967 |
| FR | 2239138 | | 2/1975 |
| GB | 856706 | | 12/1960 |
| GB | 901266 | | 7/1962 |
| GB | 1048263 | | 11/1966 |
| GB | 1471814 | | 4/1977 |
| GB | 2429751 | A | 3/2007 |
| WO | 8704951 | A1 | 8/1987 |
| WO | 9314314 | A1 | 7/1993 |
| WO | 2004053333 | A1 | 6/2004 |
| WO | 2006015766 | A1 | 3/2006 |
| WO | 2007026109 | A1 | 3/2007 |
| WO | 2009039881 | A1 | 4/2009 |
| WO | 2011029847 | | 3/2011 |

OTHER PUBLICATIONS

International Search Report dated Dec. 29, 2011 in Application No. PCT/EP2010/063179.

Office Action dated May 27, 2014 in U.S. Appl. No. 13/391,683.

Office Action dated Mar. 5, 2014 in China Patent Application No. 201080039875.2.

Office Action dated Aug. 14, 2013 in U.S. Appl. No. 13/391,683.

China Patent Application No. 201180040282.2, Office Action dated Jan. 7, 2015.

Europe Patent Application No. 11748632.4, Examination Report Oct. 30, 2014, 6 pages.

* cited by examiner

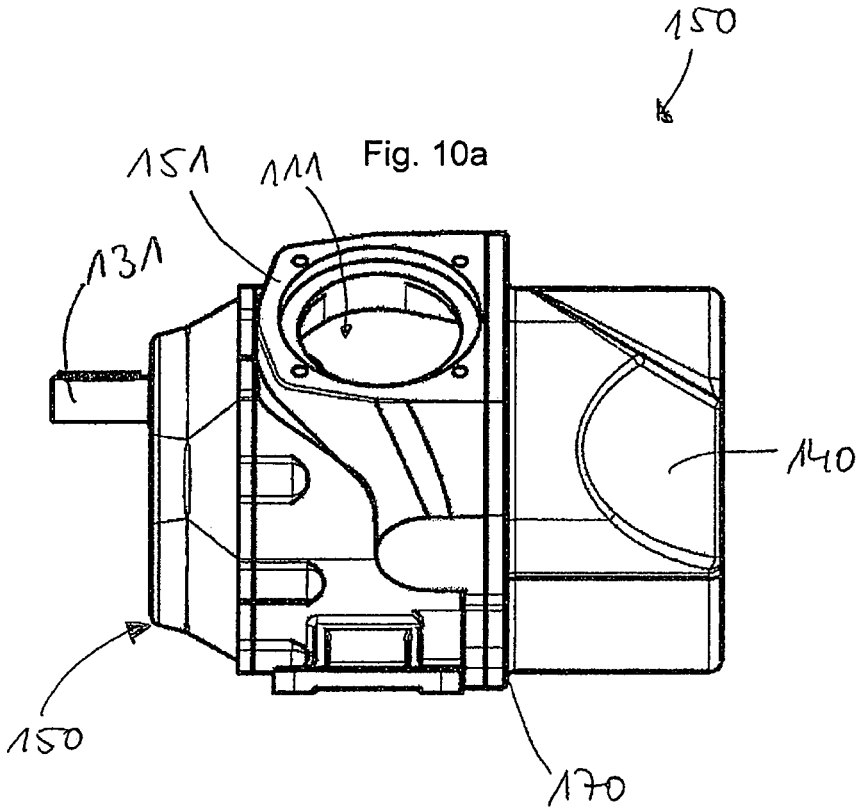
Fig. 10a
Fig. 10b
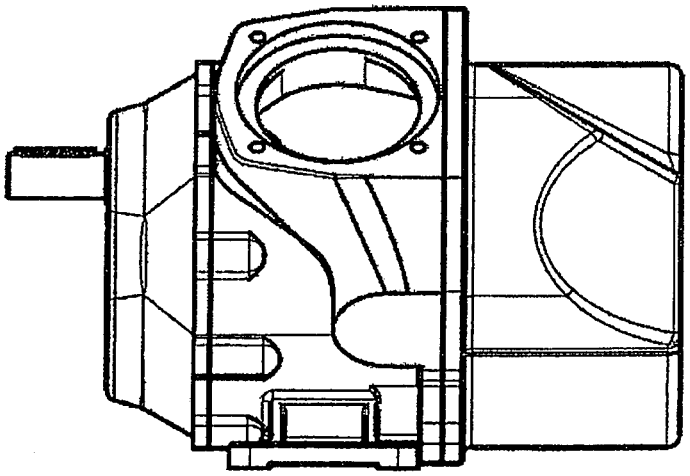

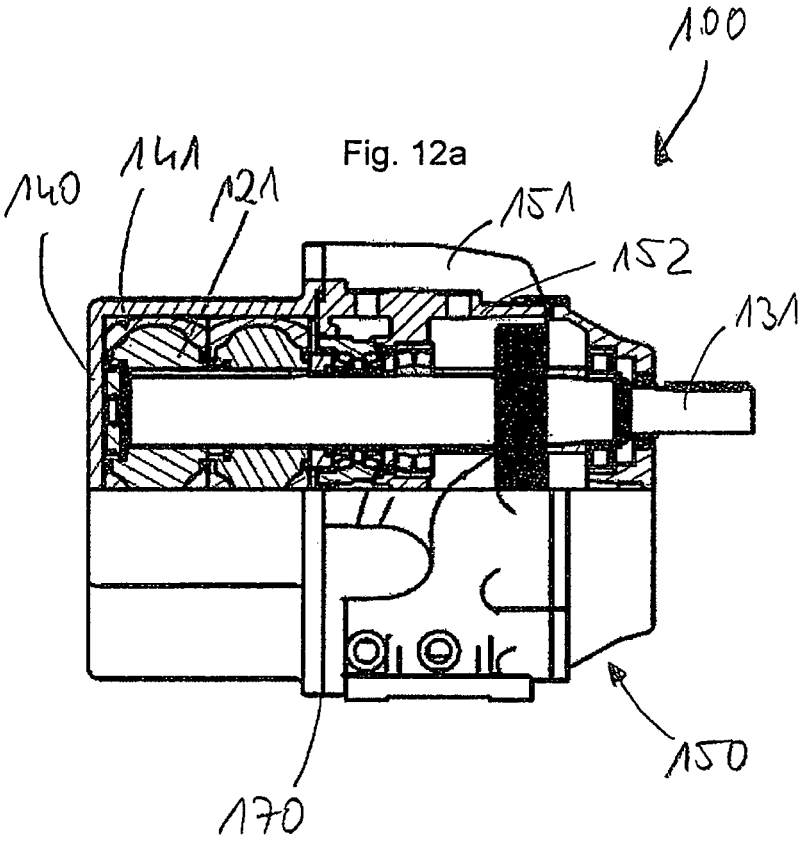
Fig. 12a
Fig. 12b
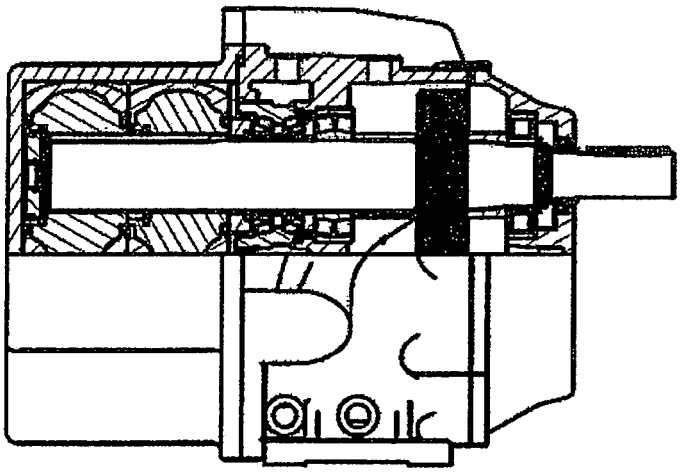

ROTARY LOBE PUMP HAVING INLET AND OUTLET ALIGNED WITH GEARBOX CASING

CROSS REFERENCE TO RELATED APPLICATIONS

This application is the U.S. national phase of International Application No. PCT/EP2011/064229 filed on Aug. 18, 2011, which application claims priority to German Patent Application No. 202010011626.0 filed on Aug. 20, 2010, the contents of both of which are incorporated herein by reference.

The invention relates to a rotary lobe pump for conveying a fluid medium containing solids, comprising an inlet opening and an outlet opening for the medium being conveyed, two rotary lobes arranged in a pump casing and having rotary lobe vanes engaging with other, wherein each of the two rotary lobes is fixed torque-resistantly on a respective shaft and can be driven by said respective shaft, and wherein the two shafts are coupled to each other by a transmission gear arranged in a gearbox casing.

The invention also relates to a construction kit for a rotary lobe pump, for providing rotary lobe pumps.

Rotary lobe pumps of the kind initially specified are known from the applicant's patents DE 10 2007 054 544 A1 and EP 1 624 189 B1, for example, and from DE 10 2005 017 575 A1 and WO 2007/026 109 A1, and are used to convey a fluid medium containing solids. For example, inhomogeneous fluids such as liquid manure can be conveyed by means of a rotary lobe pump. Via an inlet opening arranged on the pump casing, the medium to be conveyed enters the interior of the pump casing, where it is conveyed by the intermeshing rotary lobe vanes of two driven rotary lobes in the direction of an outlet opening arranged on the pump casing, and leaves the interior of the pump casing again through the outlet opening.

Rotary lobe pumps are subjected to high levels of wear due to the kind of medium to be conveyed, in particular to the solids contained therein and the fields in which rotary lobe pumps are used. Due to this high level of wear, regular maintenance of rotary lobe pumps and replacement of wearing parts is essential.

Other problems associated with rotary lobes are the leakage problems that arise when seals are inadequate or prone to wear and tear, and the deposition of solids in dead spaces.

Another disadvantage of existing rotary lobe pumps is that they cannot be deployed, or only with complications, when very little construction space is available for installation, and/or that they are not adaptable or difficult to adapt to different fields of application.

The object of the present invention is therefore to provide a rotary lobe pump for conveying a fluid medium containing solids, as well as a construction kit for a rotary lobe pump in order to provide rotary lobe pumps that reduce or eliminate one or more of the aforementioned disadvantages. Another object of the present invention is to provide a rotary lobe pump for conveying a fluid medium containing solids, as well as a construction kit for a rotary lobe pump, in order to provide rotary lobe pumps that exhibit less wear and are easier to maintain. Yet another object of the present invention is to provide a rotary lobe pump for conveying a fluid medium containing solids, as well as a construction kit for a rotary lobe pump, in order to provide rotary lobe pumps that are of compact design, yet are versatile with regard to installation, size and capacity. The object of the present invention is also to provide a rotary lobe pump for conveying a fluid medium containing solids, as well as a construction kit for a rotary lobe pump, in order to provide rotary lobe pumps that are inexpensive to produce.

These objects are achieved by a rotary lobe pump of the kind initially specified, characterized in that the inlet opening and the outlet opening are arranged on a connection casing.

The invention is based on the discovery that an advantageous rotary lobe pump can be realized by departing from the usual design with inlet and outlet openings arranged on the pump casing, with access to the rotary lobes inside the pump casing being as direct as possible. According to the invention, the inlet and outlet openings are arranged on a connection casing.

Both rotary lobes are arranged inside the pump casing, preferably inside a pump chamber formed inside the pump casing. The two rotary lobes are driven in opposite directions, their rotary lobe vanes intermeshing to convey the medium.

The inventive arrangement of the inlet and outlet openings on the connection casing and not on the pump casing has the advantage that the connection casing can be fully integrated via the inlet and outlet openings in a pipe system and that only the pump casing needs to be accessible in order to service the rotary lobe pump.

This design of the rotary lobe pump according to the invention, with spatial separation between the pump casing containing the rotary lobes and the inlet and outlet openings serving to connect the rotary lobe pump to pipelines allows the rotary lobe pump to be of very compact design and easier to maintain because the rotary lobes exposed to higher levels of wear and which have to be replaced more frequently are thus accessible and arranged independently of the connection casing and the pipelines connected thereto.

It is preferred that the connection casing be offset from the pump casing in an axial direction running parallel to the shafts. It is particularly preferred that the inlet opening and the outlet opening are spaced apart from, or adjoin, the pump casing in an axial direction parallel to the shafts, in particular from a pump chamber formed inside the pump casing. This ensures that the pipes connected to the inlet and outlet openings are spaced apart from the pump casing and that the pump casing can be easily accessed.

The invention may be developed by having the gearbox casing and the connection casing embodied as a transmission unit.

In this development of the invention, the gearbox casing and the connection casing form a constructional unit, namely the transmission unit. The gearbox casing and the connection casing may each comprise a plurality of components or may each be of integral construction. A particularly preferred embodiment is one in which the entire transmission unit is of integral construction, that is, the gearbox casing and the connection casing are embodied as a contiguous, integral component.

It is another particularly preferred that the gearbox casing be arranged at least partially inside the connection casing, and it is further preferred that at least one flow space, through which the medium to be conveyed can flow, be formed between the connection casing and the gearbox casing. The at least one flow space is preferably in fluidic communication with the inlet and outlet opening and with the interior of the pump casing, so that medium flowing in through the inlet opening can flow through the flow space to a pump chamber arranged inside the pump casing and containing the rotary lobes, from whence the medium can pass via the same or a further flow space to the outlet opening. This development of the invention is very compact and also has the advantage that the gearbox casing is cooled in this way by the medium to be conveyed, which flows around at least sections of the gearbox casing inside the flow space, thus achieving a higher power density.

In one preferred development of the inventive rotary lobe pump, the pump casing and the transmission unit are releasably connected to each other.

The pump casing may be releasably connected to the connection casing, to the gearbox casing, or to both the connection casing and the gearbox casing. The pump casing of the rotary lobe pump can thus be removed in order to service or replace the rotary lobes, for example. Due to the inlet and outlet opening not being arranged on the pump casing, according to the invention, the feed and discharge lines connected to the inlet and outlet opening do not need to be dismantled when servicing the rotary lobe pump, but can remain connected to the connection casing even when the pump casing has been removed. The accessibility of the rotary lobes and thus their maintenance and, when necessary, their installation/dismantling is substantially facilitated due to the possibility of removing the pump casing entirely from the transmission unit, and thus to lay open the rotary lobes to full view.

The invention may be developed by fixing the two rotary lobes releasably to the respective shaft.

The advantage of this development is that, when conducting maintenance that involves replacing the rotary lobes, there is no need to dismantle the shafts as well. Once the pump casing has been removed, the rotary lobes only need to be released from the shaft and can then be replaced.

The invention may be developed by arranging a wear plate between the pump casing and the transmission unit, said wear plate preferably being releasably fixed to the transmission unit.

This preferred development of the inventive rotary lobe pump has the advantage that the ease of maintenance of the rotary lobe pump is further improved by the wear plate being arranged at the connection point of the transmission unit and the pump casing and for that reason is very easy to access and can quickly be replaced. It is particularly preferred that the wear plate be releasably fixed to the transmission unit, so that, for example when removing the pump casing from the transmission unit in order to replace the rotary lobes, the wear plate is easy to access, yet is stably fixed to the transmission unit, in the event that the wear plate is to be replaced or dismantled some other time. The wear plate may be releasably connected to the connection casing, to the gearbox casing, or to both the connection casing and the gearbox casing.

It is particularly preferred that the rotary lobe pump have only one wear plate.

The structure of the rotary lobe pump according to the invention and its developments allow just one wear plate to be required, in contrast to the prior art rotary lobe pumps with two wear plates. This has the advantage that less time is needed for maintenance, since fewer wearing parts need to be replaced. A smaller number of wearing parts also means a reduction in maintenance expenses.

The invention may be developed by both shafts of the transmission unit being rotatably mounted and that a portion of each shaft projects into a pump chamber formed inside the pump casing. It is particularly preferred that the pump casing has no bearing for the two shafts.

In this preferred development of the invention, the bearings for the two drive shafts of the rotary lobes are located in the transmission unit, or preferably in the gearbox casing. The shafts project into the pump chamber in the pump casing in such a way that the two rotary lobes are fixed torque-resistantly to the shafts and can be driven accordingly by the respective shaft. It is preferred, in particular, that the shafts are not mounted additionally on bearings in the pump casing.

This development has the advantage that, when the pump casing is removed from the transmission unit and also when the rotary lobes are removed from the shafts, the shafts are mounted solely and entirely in the transmission unit, also during maintenance, and that there is no need to install or dismantle shaft bearings in the pump casing.

Another advantage of this development is that the pump casing can thus be made particularly simple in design and can therefore be produced faster and more cost-efficiently than casing parts which include shaft bearings.

A particularly preferred development is therefore one in which the pump casing is of integral construction.

The advantage of the pump casing being of integral construction, compared to a prior art construction as two half-shells, is that the pump casing can be produced more cost-efficiently, and can be installed and dismantled faster and more simply than a pump casing in two parts, and that an additional point of separation that must be sealed and which therefore poses a risk of leakage can be avoided.

The invention can be developed by the inlet opening being connected via a first flow channel and the outlet opening being connected via a second flow channel to a pump chamber formed inside the pump casing, wherein at least one respective part of the first and second flow channels runs in a substantially axial direction parallel to the shafts.

Due to the inventive arrangement of the inlet and outlet opening on the connection casing, it is necessary to provide flow channels, through which the medium to be conveyed can flow from the inlet opening into the pump chamber formed inside the pump casing and from the pump chamber to the outlet opening. In this preferred development, the flow channels, or at least sections thereof, are arranged axially, that is to say, parallel to the rotational axis of the shafts. The flow channels may be formed within, or as part of one or more flow spaces between the connection casing and the gearbox casing. This partially axial inflow and outflow of the medium to the pump casing overcomes the axial distance between the inlet and outlet openings arranged on the connection casing and the pump chamber formed which is formed inside the pump casing and which contains the rotary lobes.

The invention can be developed by arranging the inlet opening and the outlet opening in the upper half of the connection casing during operation of the rotary lobe pump.

This development of the invention has the advantage that an excellent supply of fluid is achieved at all times, thus enabling the rotary lobe pump to operate particularly efficiently with a high power density.

It is particularly preferred that the inlet opening and the outlet opening be arranged on the connection casing during operation of the rotary lobe pump in such a way that a first axis at right angles to a plane encompassing the inlet opening, and a second axis at right angles to a plane encompassing the outlet opening are each inclined at an angle of 45° from the vertical.

The advantage of this development of the invention is not only that an excellent fluid feed and a high power density are achieved, but also that inlet and outlet connection members to be connected to the inlet and outlet openings can be variably adjusted for different installation situations.

A particularly preferred development in this regard is characterized by an inlet connection member which is attached to the inlet opening and includes an inlet flange, and by an outlet connection member which is attached to the outlet opening and includes an outlet flange, wherein the inlet connection member and the outlet connection member are designed and attachable to the connection casing in such a way that the inlet and/or outlet flange is/are arranged horizontally in a first fixing position and/or that the inlet and/or outlet flange is/are arranged perpendicularly in a second fixing position during operation of the rotary lobe pump.

In this development of the invention, inlet and outlet members are provided which can be arranged at and fixed to the inlet and outlet openings on the connection casing and which each have an inlet or outlet flange, respectively, for connecting the inlet or outlet member to a pipe. It is now preferred that the inlet and the outlet connection member be embodied in such a way that they can be arranged in at least two different ways on the inlet or outlet opening on the connection casing. The respective connection member may be arranged in such a way that the associated flange is arranged horizontally or perpendicularly during operation of the rotary lobe pump. This gives rise to the following preferred combinations. the inlet and outlet connection members are arranged in such a way that the inlet and outlet flanges are arranged horizontally during operation of the rotary lobe pump, the inlet and outlet connection members are arranged in such a way that the inlet and outlet flanges are arranged perpendicularly during operation of the rotary lobe pump, or the inlet and outlet connection members are arranged in such a way that one of the two connection members is arranged horizontally during operation of the rotary lobe pump and the other one of the two connection members is arranged perpendicularly during operation of the rotary lobe pump. It is possible in this way, with a compact design of the rotary lobe pump, to deploy the rotary lobe pump in many different installation situations.

The invention may be developed by the connection casing having at least one releasably closable drain hole through which the medium being conveyed can be drained.

This development of the invention makes maintenance of the rotary lobe pump easier, in that it permits complete or almost complete emptying of the connection casing, or at least of a flow space formed between the connection casing and the gearbox casing, with the result that no medium to be conveyed continues to flow when the rotary lobe pump is opened for maintenance purposes, for example. To achieve this, the drain hole is opened before any maintenance is carried out. During operation of the rotary lobe pump, the at least one drain hole is preferably closed to prevent any undesired leakage of the medium being conveyed.

Another aspect of the invention relates to a construction kit for a rotary lobe pump, for providing rotary lobe pumps of different size and/or capacity, comprising an inventive rotary lobe pump as described in the foregoing and further characterized by at least two additional rotary lobes of a different size and having rotary lobe vanes engaging with each other, wherein the two shafts and the at least two additional rotary lobes of a different size are designed in such a way that the at least two additional rotary lobes of a different size are each releasably attachable to the respective one of the two shafts.

According to this aspect of the invention, a rotary lobe pump according to the invention and its developments may form part of a construction kit for a rotary lobe pump, which allows a rotary lobe pump according to the invention to be converted, by replacing the rotary lobes, to a rotary lobe pump according to the invention that has a different size and/or a different capacity. The construction kit for a rotary lobe pump has two pairs of rotary lobes of different sizes, in particular of different lengths, such that either the first pair of two rotary lobes or the second pair of two rotary lobes is fixed to the shafts. An inventive construction kit for a rotary lobe pump may also include more than two pairs of rotary lobes of different sizes. More specifically, when the pump casing is releasably fixed to the transmission unit, the the rotary lobe pump can be modified very quickly and simply in respect of its size and/or capacity by replacing the rotary lobes.

The construction kit for a rotary lobe pump may be developed by providing at least one additional pump casing of a different size, wherein the transmission unit and the at least one additional pump casing of a different size are designed in such a way that the at least one additional pump casing of different size is releasably attachable to the transmission unit.

This development of the invention has the advantage that it is possible to realize a significantly greater range of sizes and/or capacities of the rotary lobe pumps to be provided with the construction kit for a rotary lobe pump, since it is also possible, for larger and in particular for longer rotary lobes, to provide a larger, in particular a longer pump casing having a suitably larger pump chamber for accommodating the rotary lobes. In this way, by merely replacing the rotary lobes and, if necessary, the pump casing, it is possible to vary the size and/or the capacity of the rotary lobe pump quickly and simply, without having to dismantle the transmission unit with the connection casing and gearbox casing from a piping system.

Figure 1B:
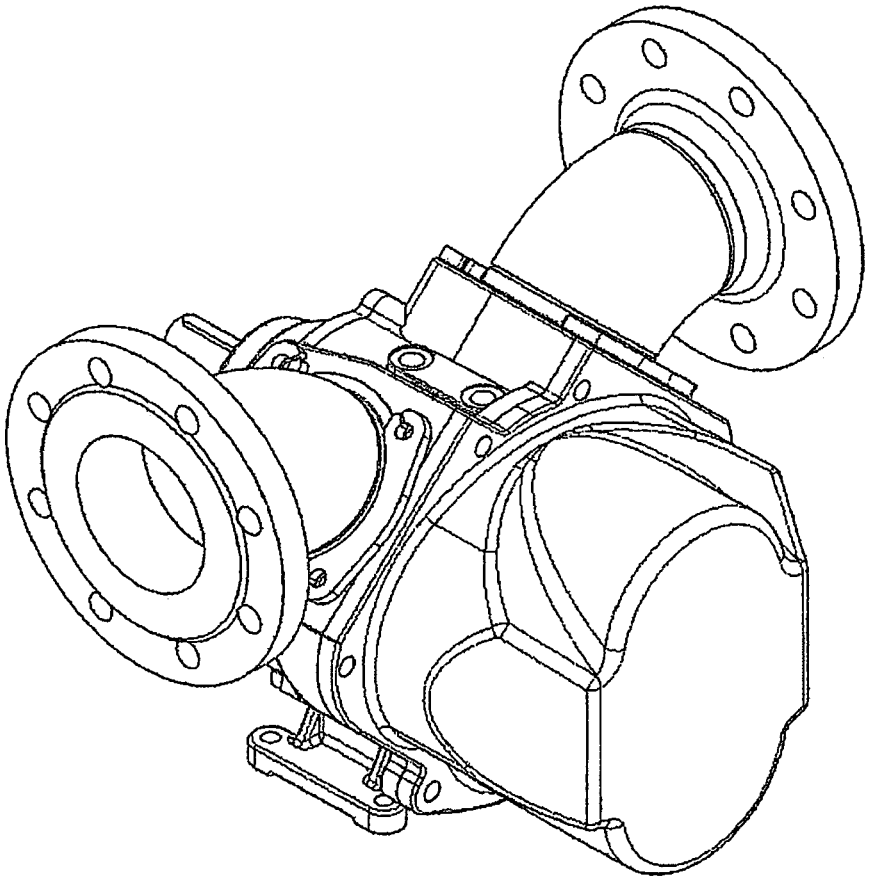
Figure 2A:
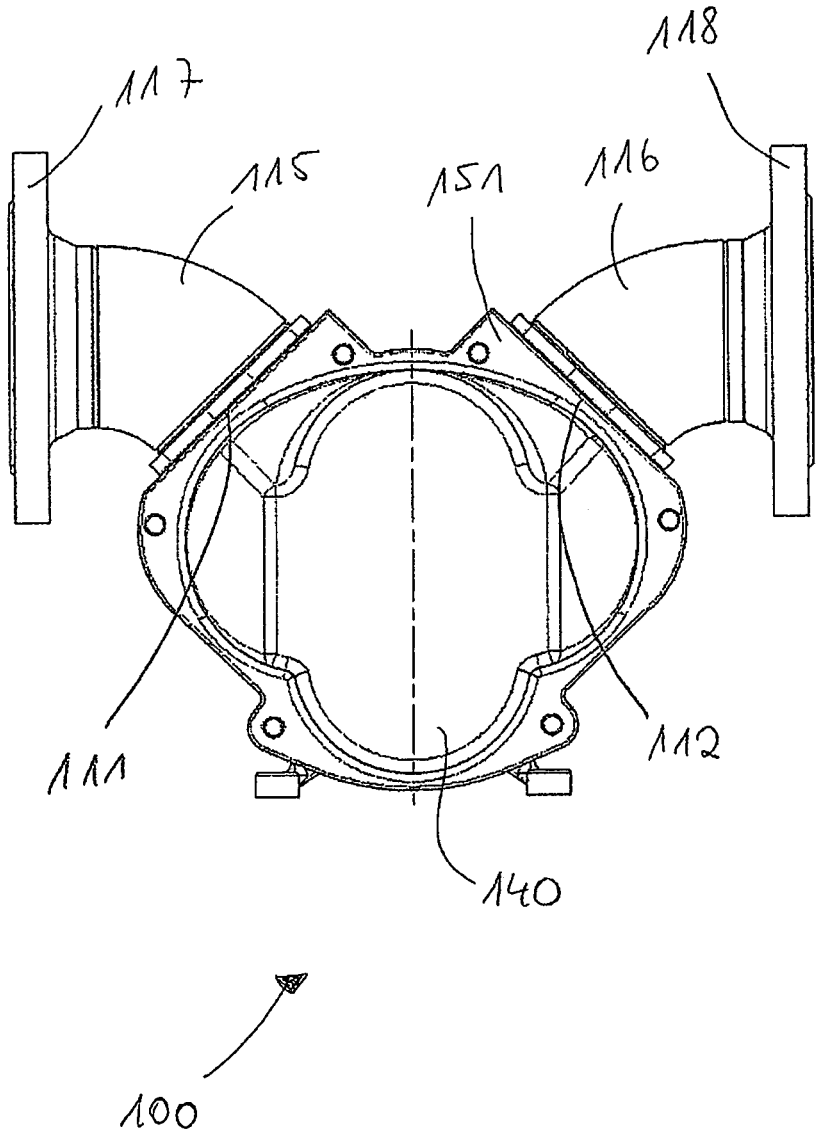
Figure 2B:
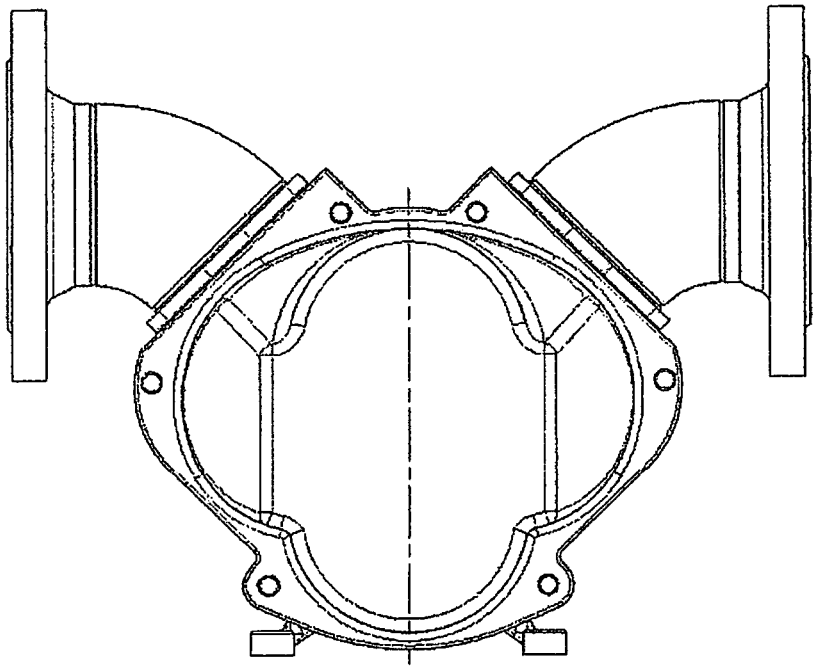
Figure 3A:
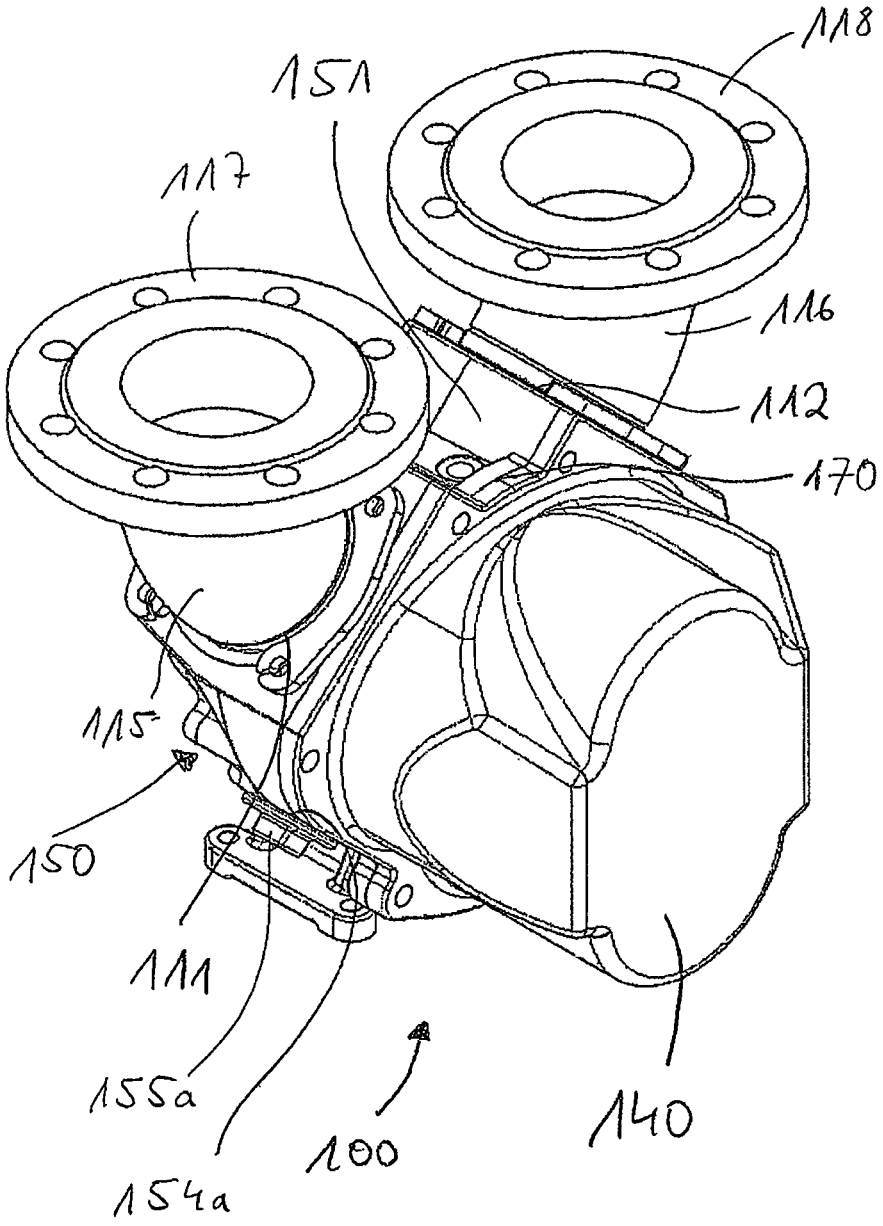
Figure 3B:
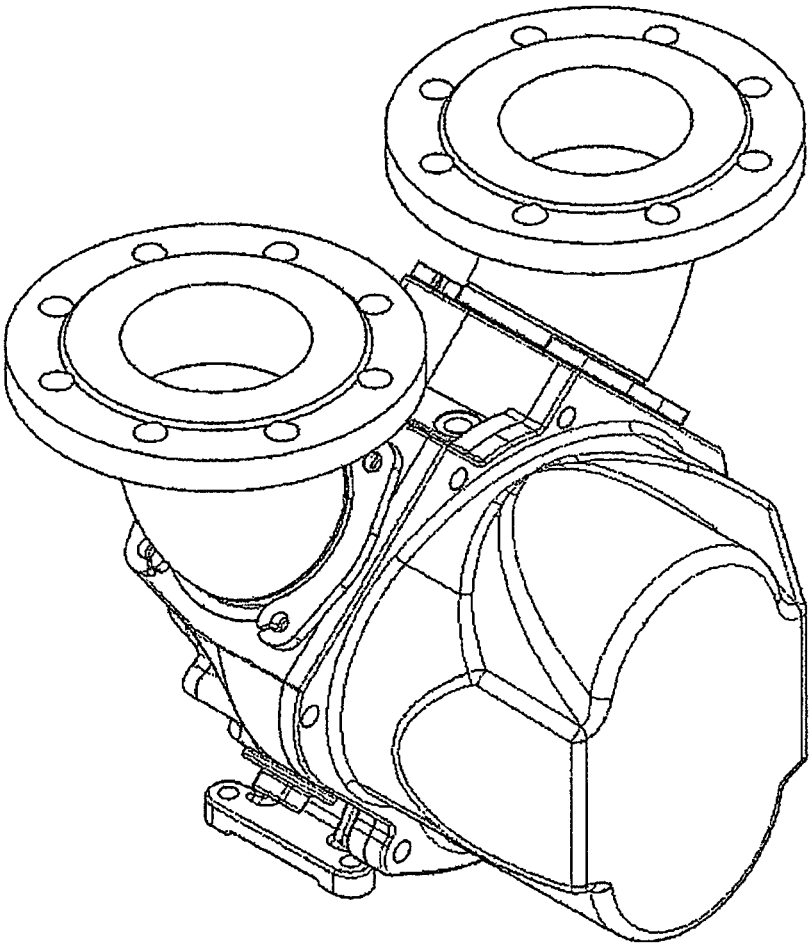
Figure 4A:
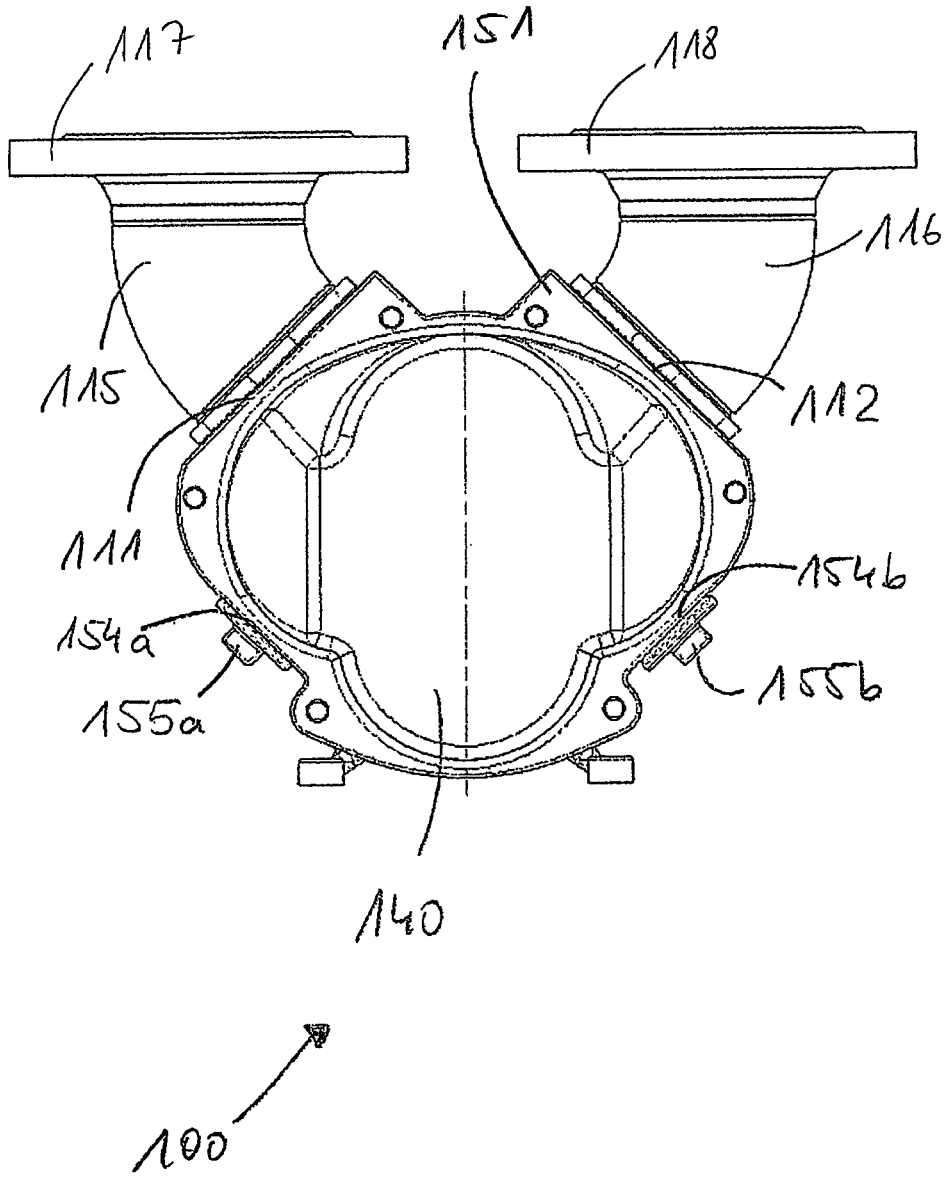
Figure 4B:
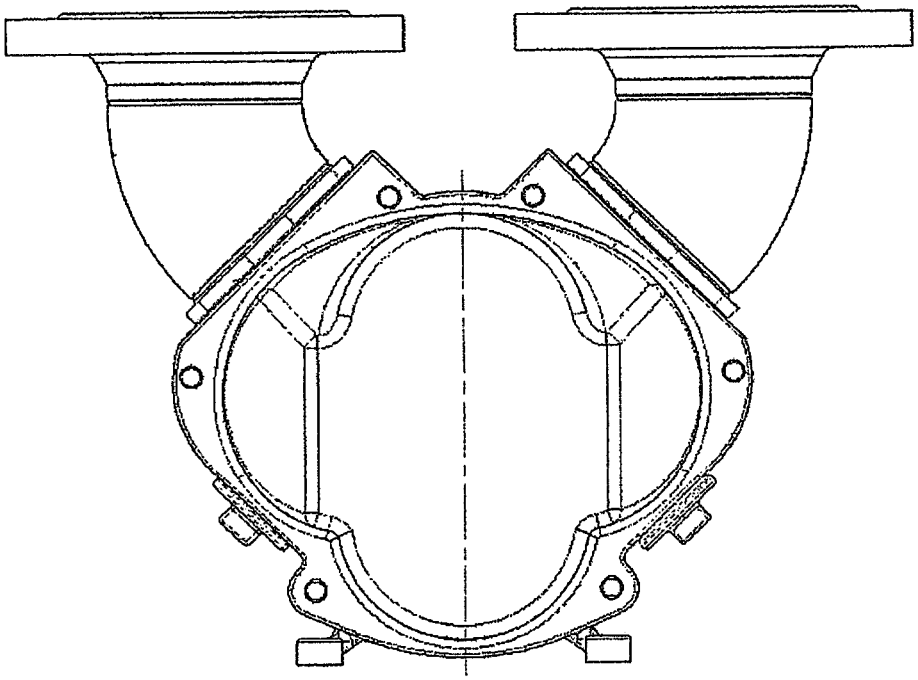
Figure 5A:
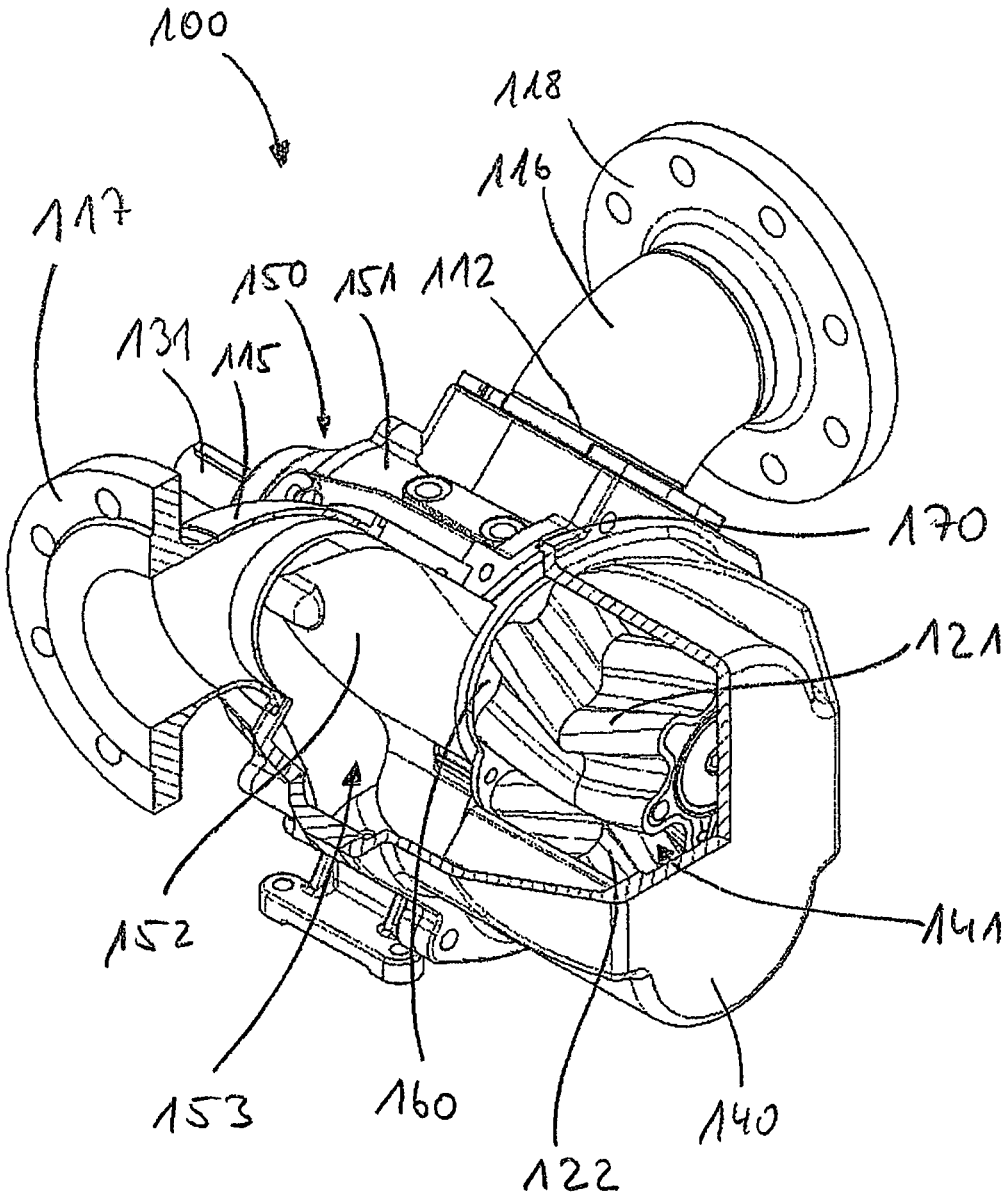
Figure 5B:
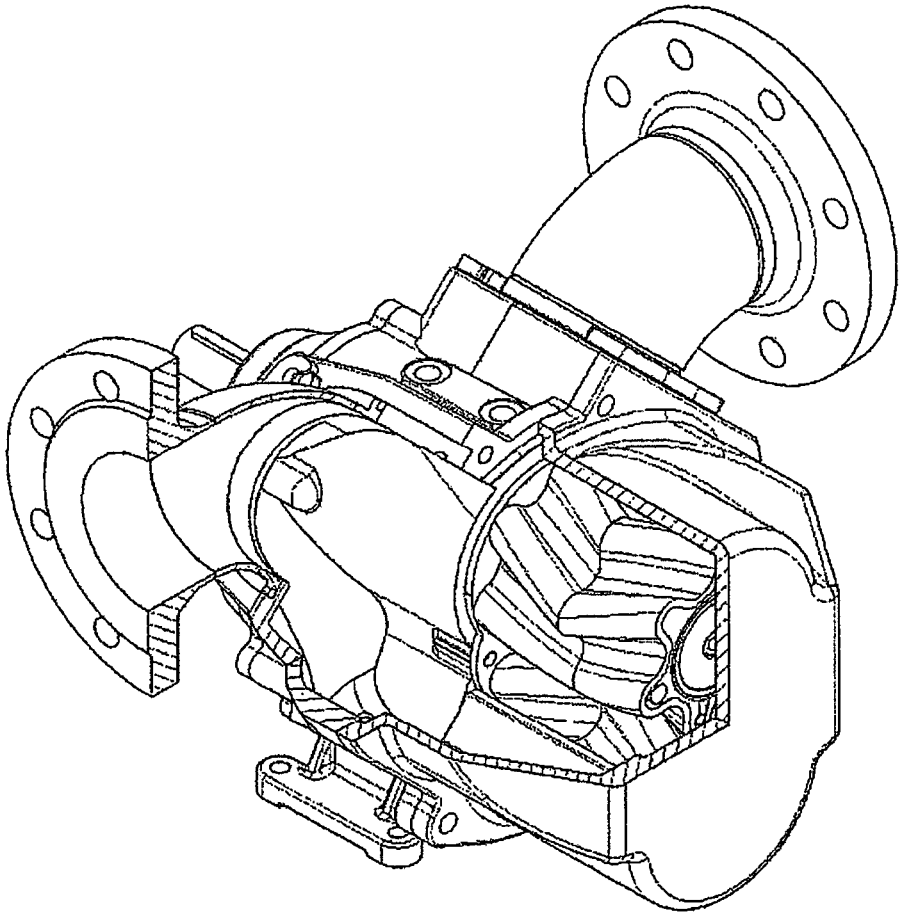
Figure 6A:
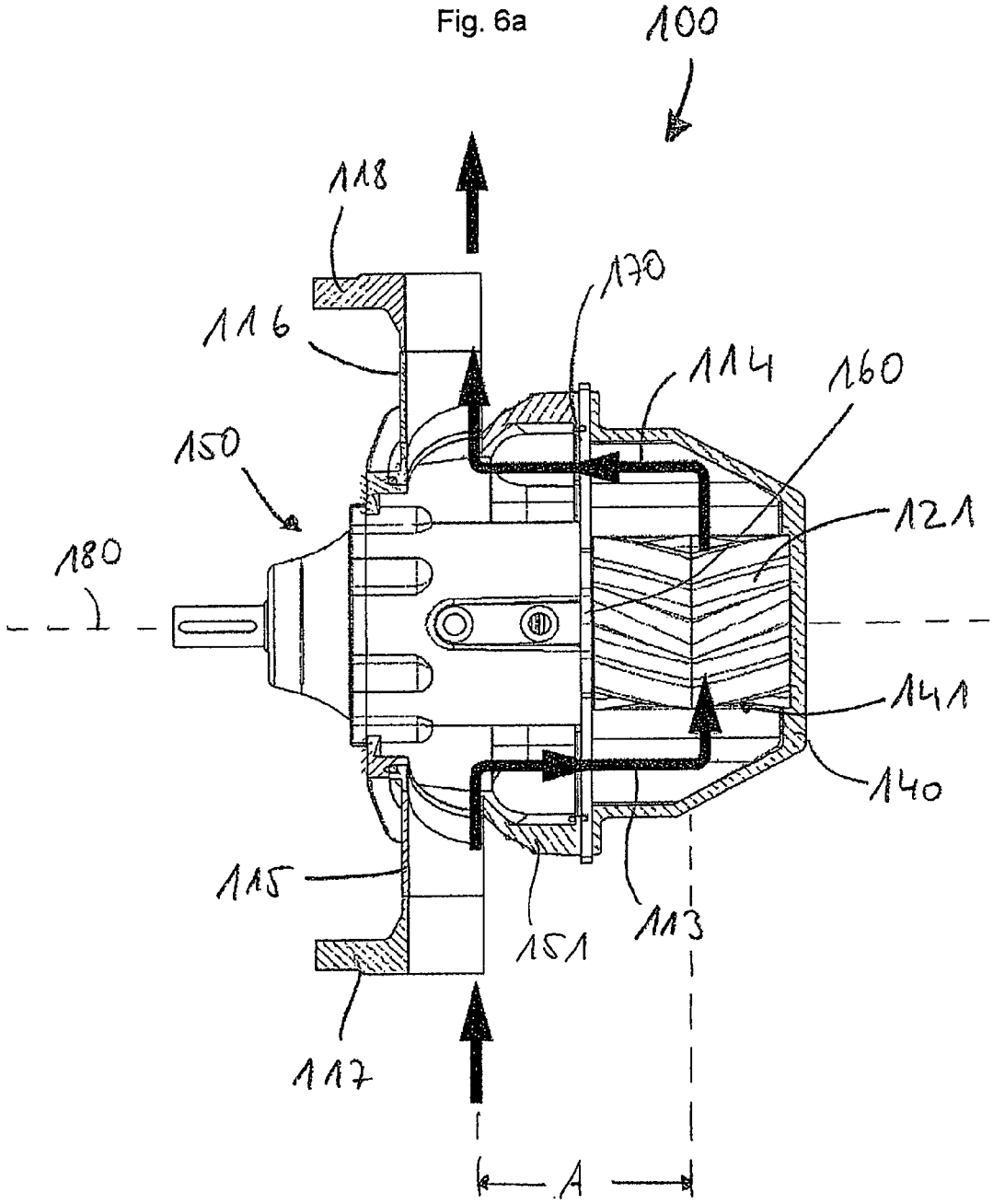
Figure 6B:
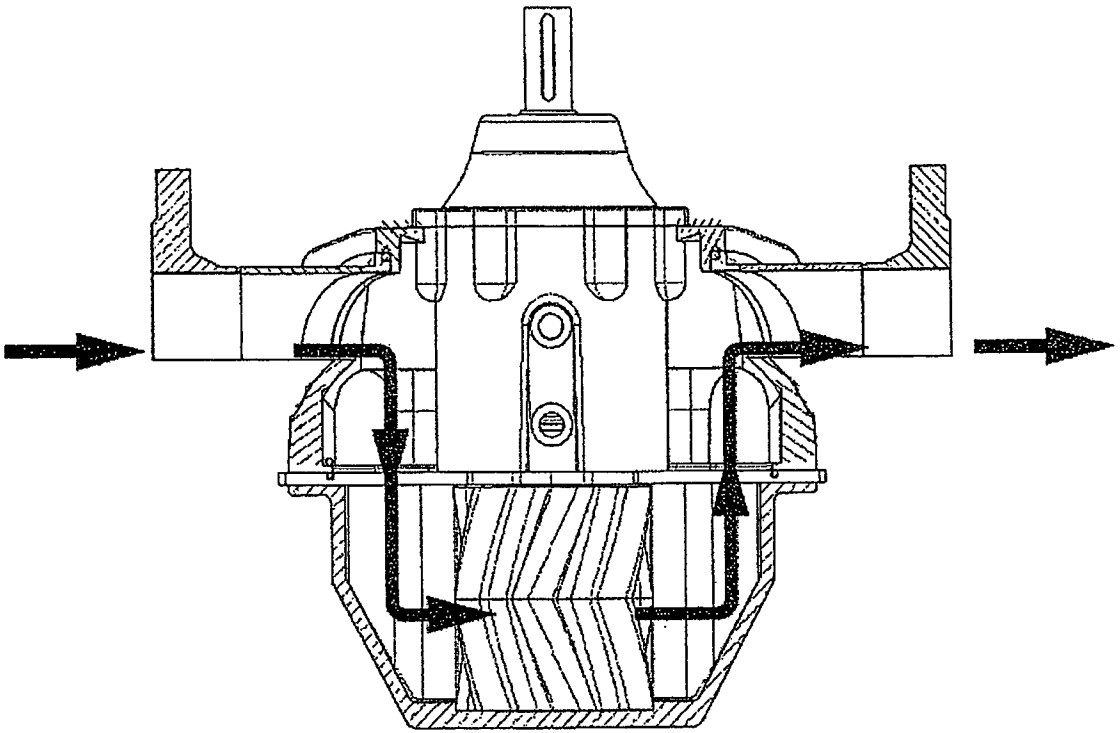
Figure 7A:
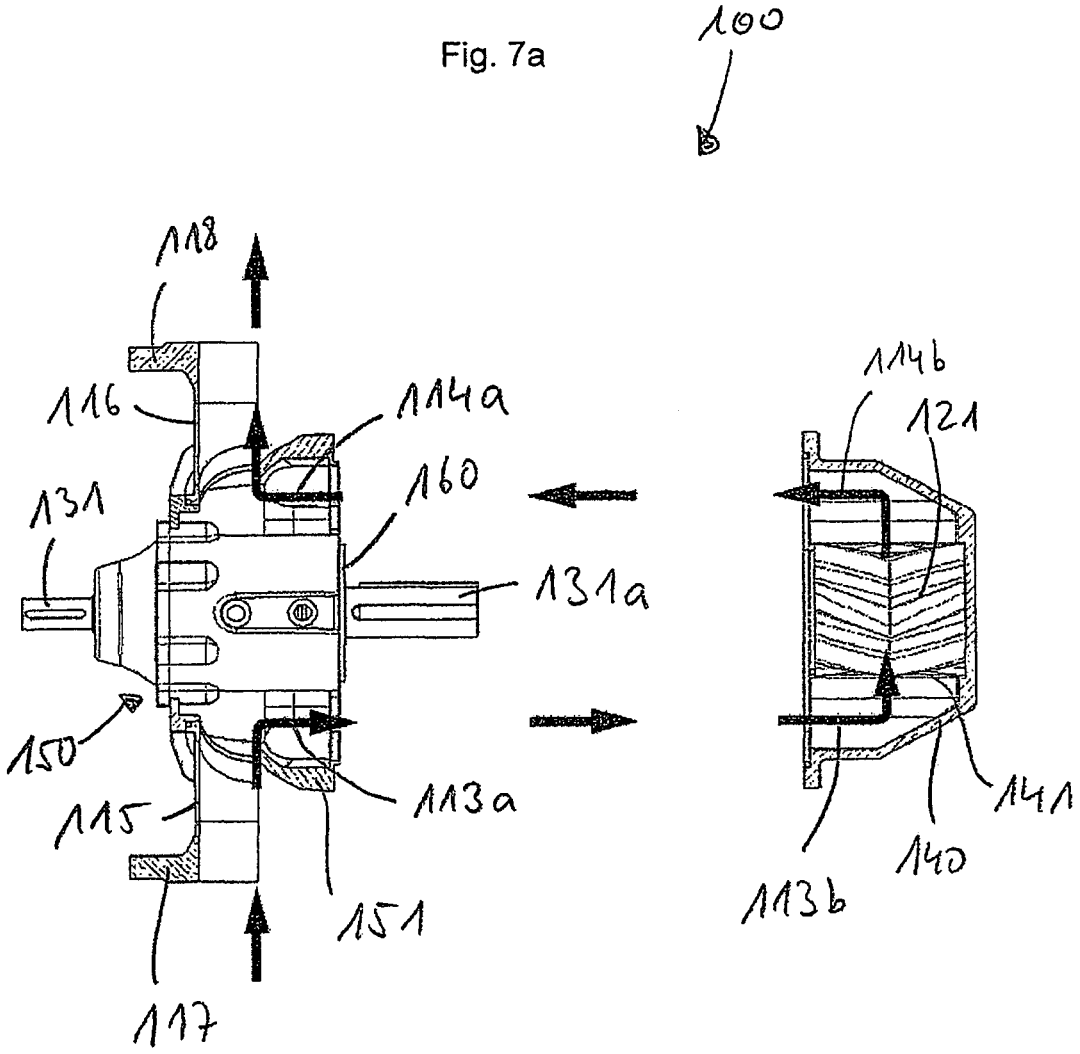
Figure 7B:
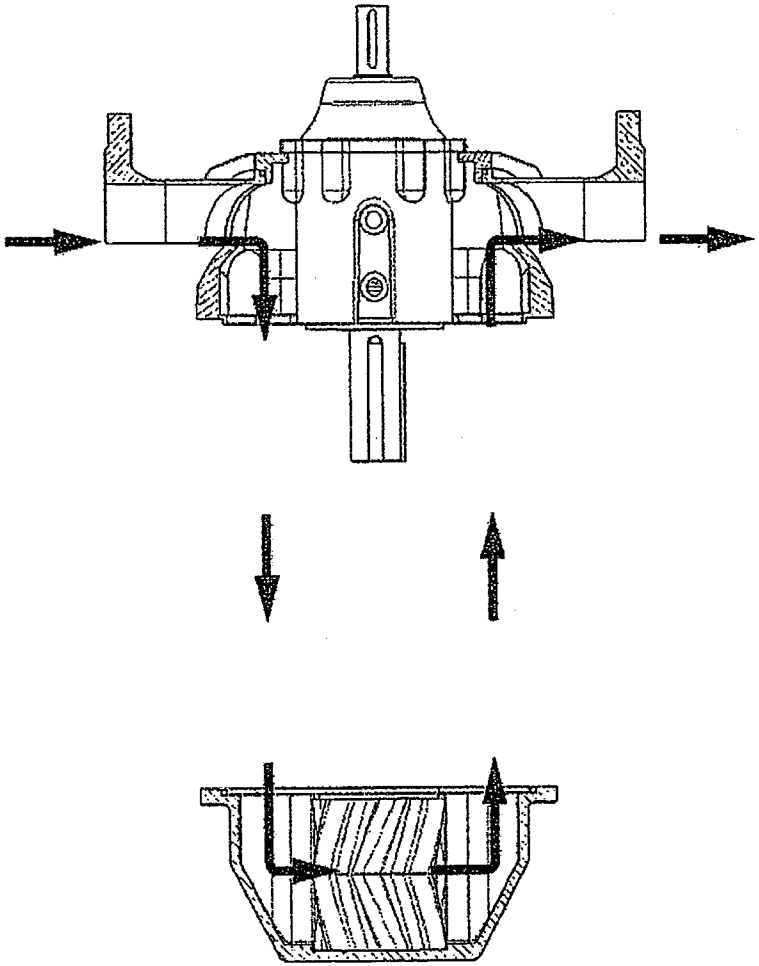
Figure 8A:
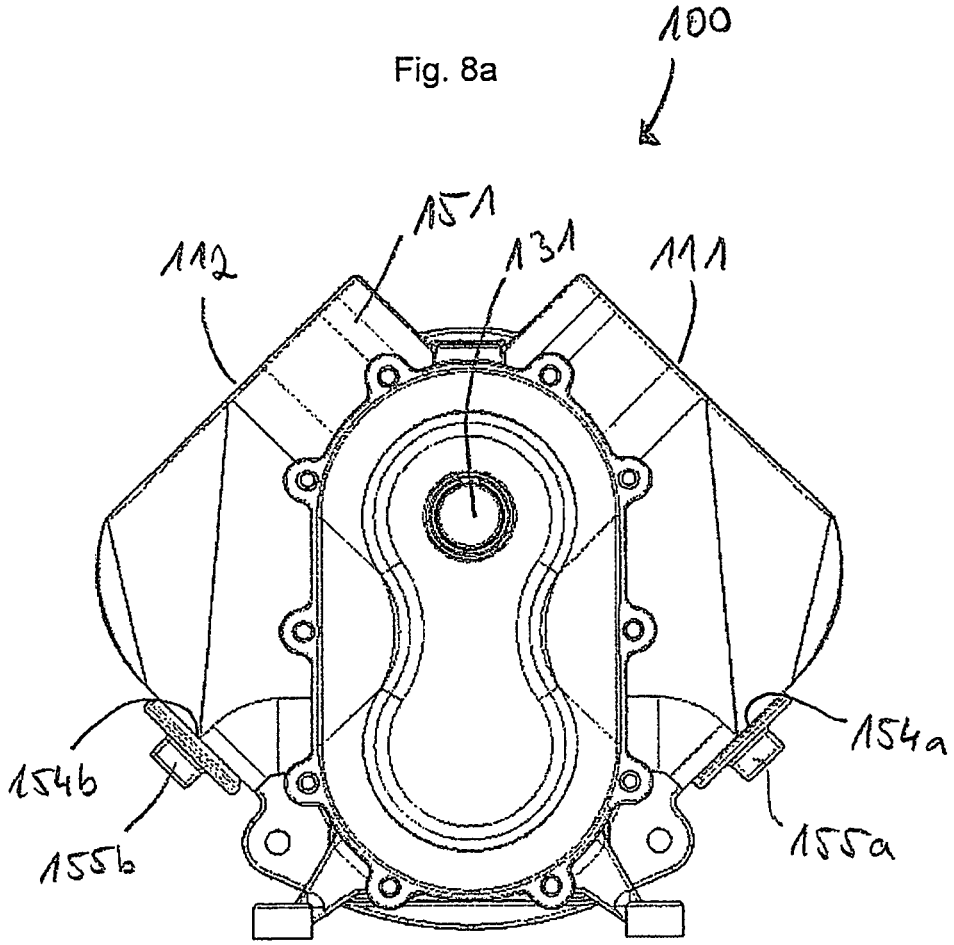
Figure 8B:
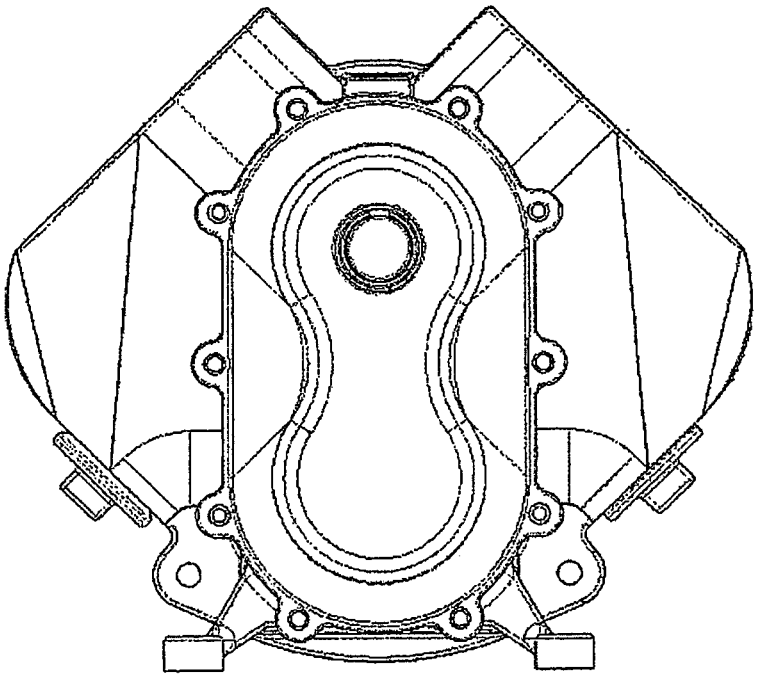
Figure 9A:
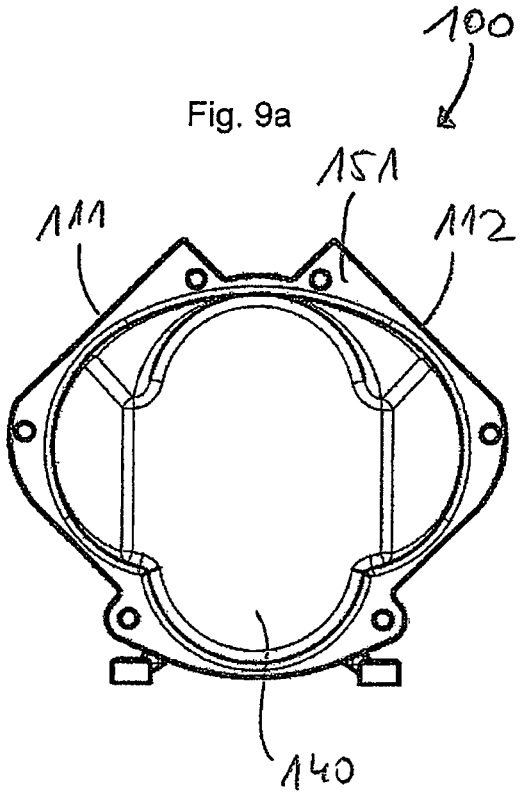
Figure 9B:
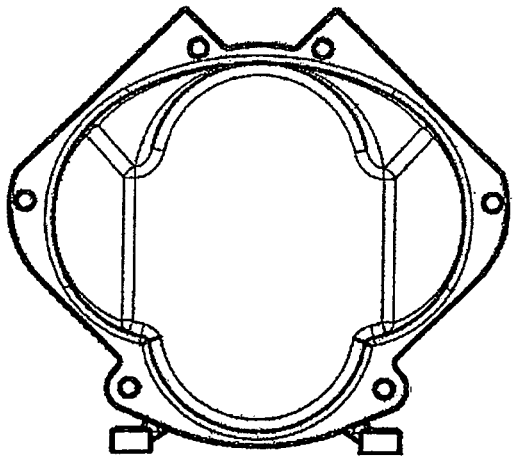
Figure 11A:
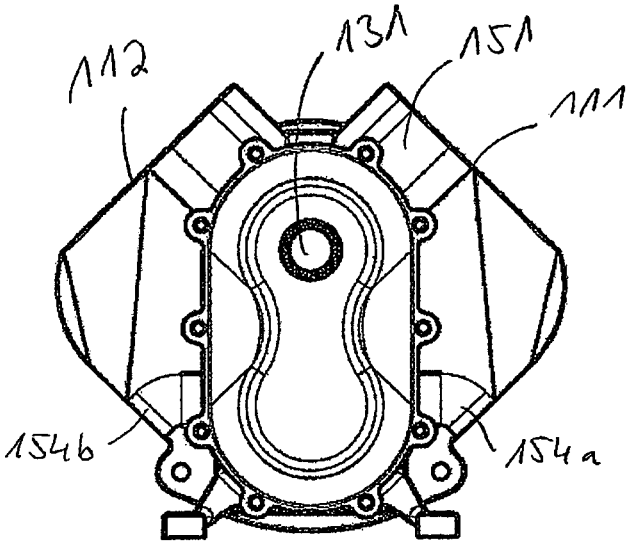
Figure 11B:
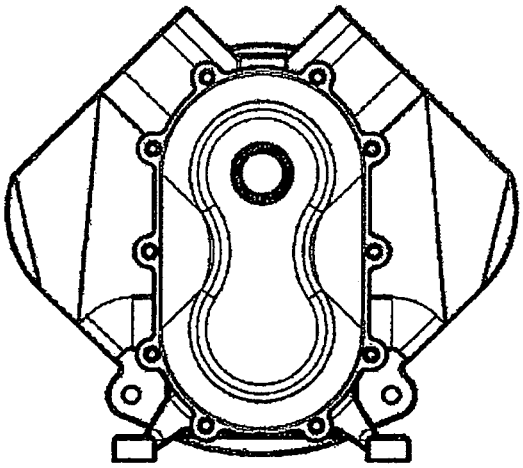
Figure 13A:
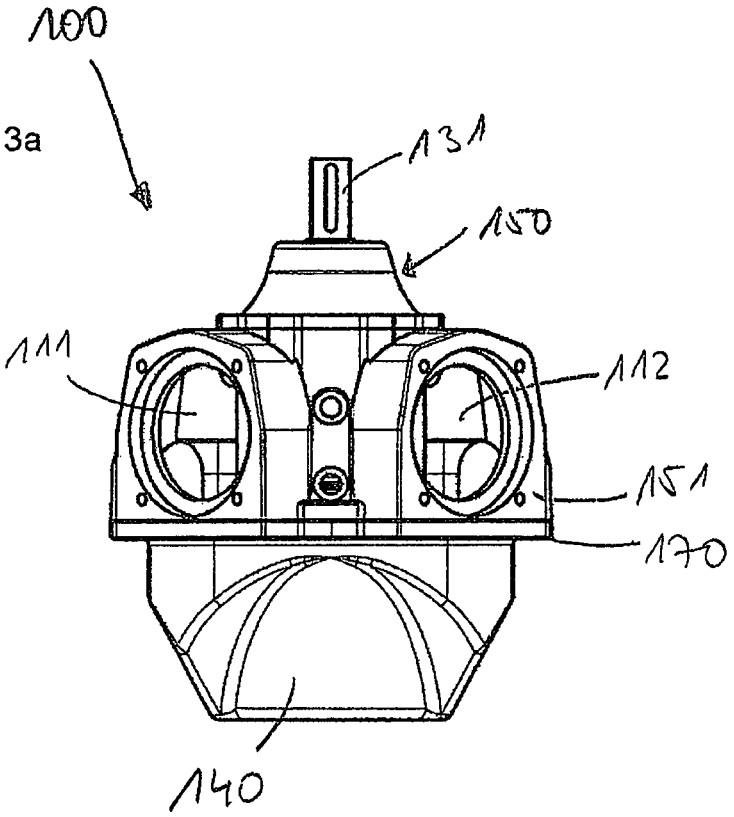
Figure 13B:
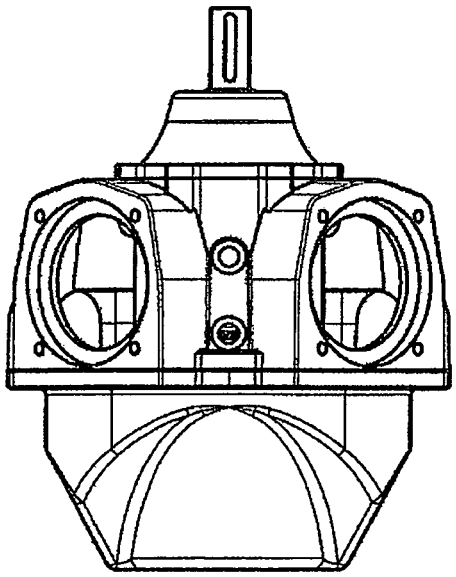
Figure 14A:
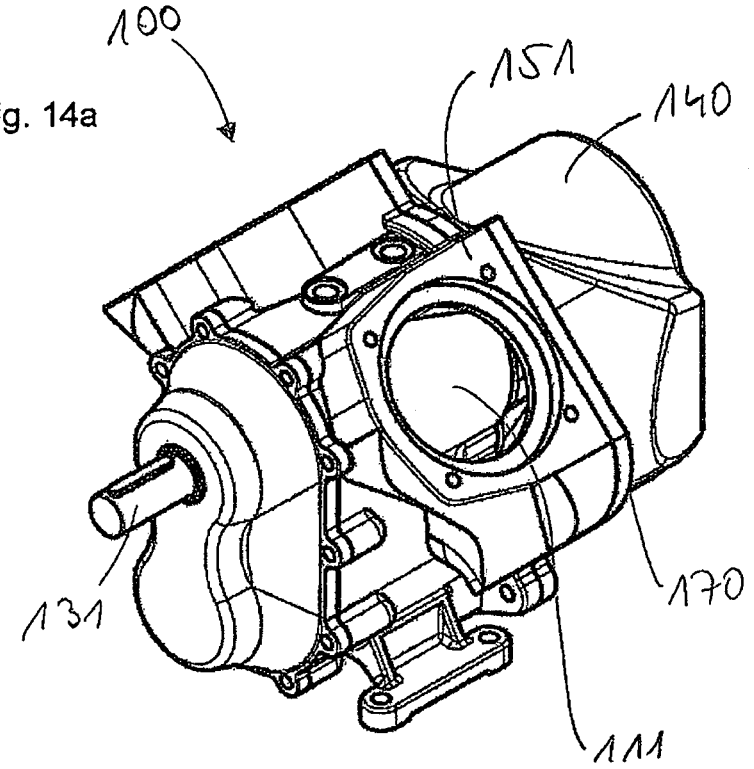
Figure 14B:
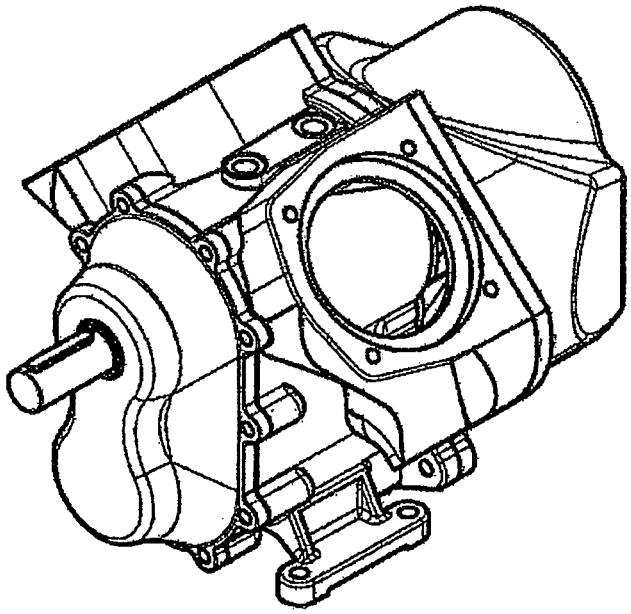
Figure 15A:
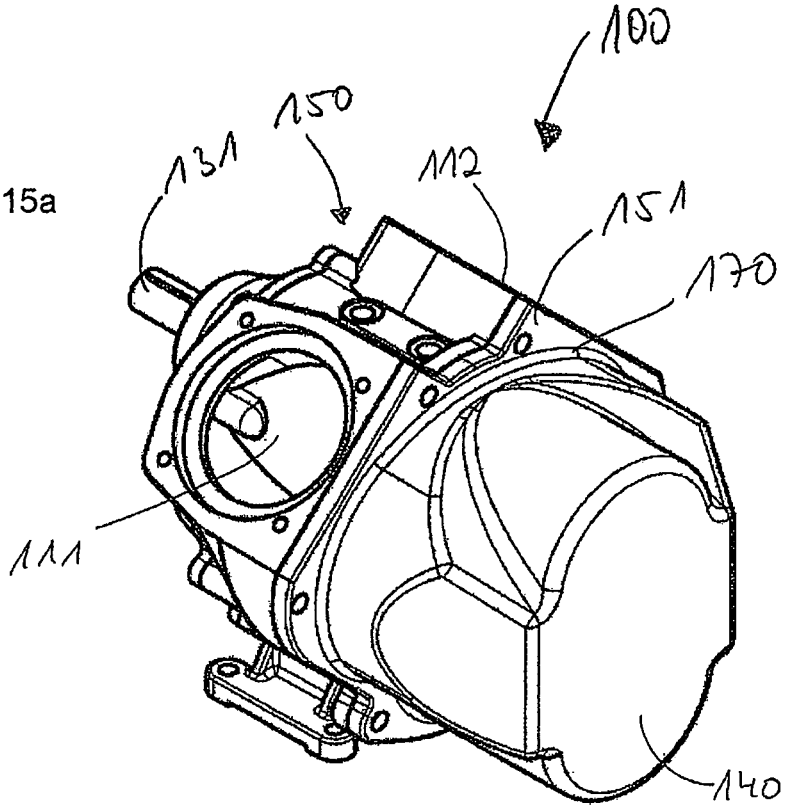
Figure 15B:
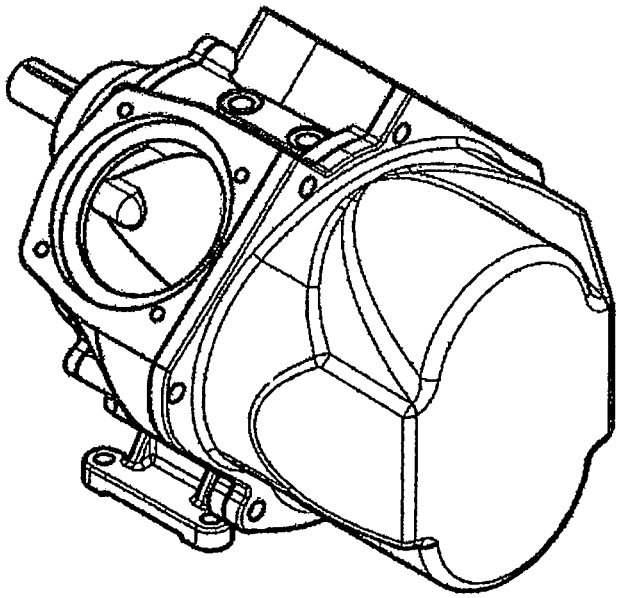
Figure 16A:
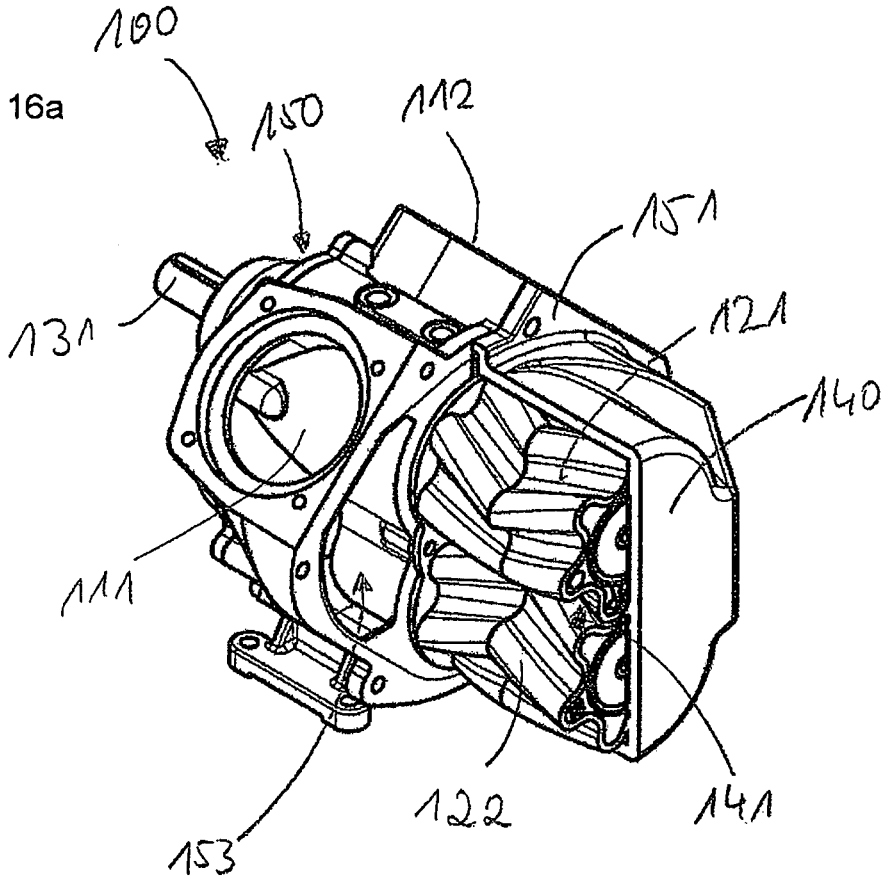
Figure 16B:
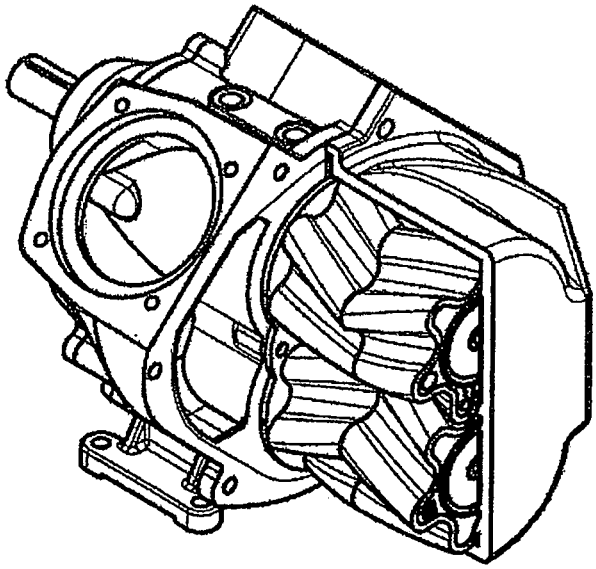

A preferred embodiment of the invention shall now be described with reference to the Figures, in which:

FIG. 1: shows a three-dimensional view of a first embodiment of a rotary lobe pump according to the invention, FIG. 2: shows a front view of the rotary lobe pump shown in FIG. 1, FIG. 3: shows a three-dimensional view of another embodiment of a rotary lobe pump according to the invention, in a variant provided with a drain hole, FIG. 4: shows a front view of the rotary lobe pump shown in FIG. 3, FIG. 5: shows a partially cutaway three-dimensional view of the rotary lobe pump shown in FIG. 1, FIG. 6: shows a longitudinal cross-section of the rotary lobe pump shown in FIG. 1, FIG. 7: shows the cross-section of FIG. 6, with the pump casing removed, FIG. 8: shows a rear view of a further embodiment of a rotary lobe pump according to the invention, without inlet and outlet connection members, in a variant provided with a drain hole, FIG. 9: shows a front view of a further embodiment of a rotary lobe pump according to the invention, without inlet and outlet connection members, FIG. 10: shows a side view of the rotary lobe pump shown in FIG. 9, FIG. 11: shows a rear view of the rotary lobe pump shown in FIG. 9, FIG. 12: shows a partially cutaway side view of the rotary lobe pump shown in FIG. 9, FIG. 13: shows a plan view of the rotary lobe pump shown in FIG. 9, FIG. 14: shows a first three-dimensional view of the rotary lobe pump shown in FIG. 9, FIG. 15: shows a second three-dimensional view of the rotary lobe pump shown in FIG. 9, FIG. 16: shows the three-dimensional view shown in FIG. 15, with a partially cutaway view of the pump casing.

Figure 17:
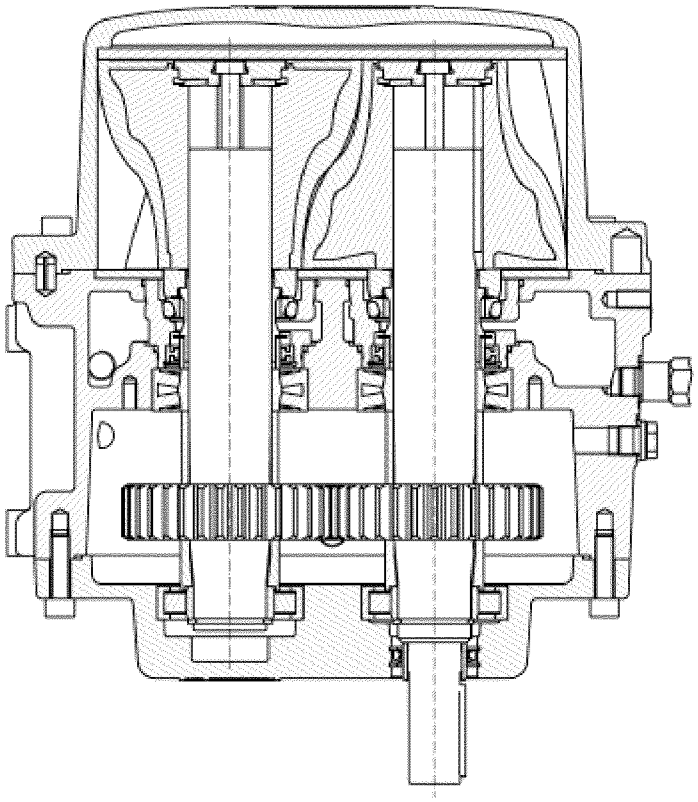

FIG. 17 shows a full cross-sectional side view of the rotary lobe pump shown in FIG. 12.

All the Figures are shown once with reference signs (the respective Figure number with an appended letter "a") and once—for clearer presentation—without reference signs (the respective Figure number with an appended letter "b").

The rotary lobe pump (100) according to the invention has an inlet opening (111) and an outlet opening (112) for the medium being conveyed.

As can be seen from FIGS. 1-7, an inlet connection member 115 provided with an inlet flange 117 can be fixed to inlet opening 111. By means of said inlet flange 117, rotary lobe pump 100 can be connected during operation to a pipeline (not shown). As can likewise be seen from FIGS. 1-7, an outlet connection member 116 provided with an outlet flange 118 can be fixed to outlet opening 112. By means of said outlet flange 118, rotary lobe pump 100 can be connected during operation to a pipeline (not shown).

As can be seen from the embodiments without inlet and outlet connection members, as shown in FIGS. 8-16, the arrangement of said connection members is optional.

FIGS. 1 and 2 show an embodiment of a rotary lobe pump according to the invention 100, in which connection members 115, 116 are so arranged that the respective flanges 117, 118 of connection members 115, 116 are arranged substantially perpendicularly when installed on the rotary lobe pump, such that the respective pipes (not shown) to be connected to said flanges 117, 118 run substantially horizontally, in a 90° connection.

In the embodiment of the rotary lobe pump 100 shown in FIGS. 3 and 4, the two connection members 115, 116 are embodied as gooseneck connections, i.e., the two flanges 117, 118 are arranged substantially horizontally when installed on the rotary lobe pump, such that pipes to be connected to flanges 117, 118 run substantially perpendicularly when connected to the rotary lobe pump.

It is also possible to mount only one of the two connection members with a perpendicular flange and the respective other connection members with a substantially horizontal flange. This provides the inventive rotary lobe pump 100 with additional flexibility for adapting to different installation situations.

As can be seen by looking at the Figures in combination, it is possible by rotated mounting of connection members 115, 116 to convert the inventive rotary lobe pump 100 very easily from a gooseneck to a 90° connection and vice versa, or to use rotary lobe pump 100 entirely without connection members or with only one connection member. This has the advantage that the inventive rotary lobe pump 100 is very compact in design and can be adapted simply and quickly to different installation situations.

Other essential characteristics of the inventive rotary lobe pump 100 are independent of the way in which inlet and outlet connection members 115, 116 are mounted. The features, functionality and advantages described in the following therefore apply equally to the various embodiments of an inventive rotary lobe pump 100 as shown in the Figures. Identical elements, or elements with substantially the same function are therefore marked with the same reference signs.

Inlet opening and outlet opening 111, 112 are arranged on a connection casing 151 of rotary lobe pump 100. The rotary lobe pump 100 also has a pump casing 140.

Inside pump casing 140, a pump chamber 141 is formed, in which two rotary lobes 121, 122 with intermeshing rotary lobe vanes are arranged. The first rotary lobe 121 is fixed torque-resistantly to a shaft 131 by which it can be driven. The second rotary lobe 122 is fixed torque-resistantly to a second shaft (not shown) and can be driven by the latter. The two shafts are typically driven in opposite directions, and for that purpose are coupled to each other via an appropriate transmission. Such a transmission (not shown) is located in a gearbox casing 152. Said gearbox casing 152 and connection casing 151 together form a transmission unit 150. In the embodiment shown here, gearbox casing 152 is arranged at least partially inside connection casing 151. A flow space 153, via which inlet opening 111 is in fluidic communication with pump chamber 141, is formed between connection casing 151 and gearbox casing 152. Rotary lobe pump 100 preferably includes an additional flow space (not shown), via which outlet opening 112 is in fluidic communication with pump chamber 141.

Inlet opening and outlet opening 111, 112 are spaced apart from pump casing 140 in an axial direction running parallel to shaft 131. Connection casing 151 and pump casing 140 are offset from each other in the axial direction and adjoin each other in the axial direction. As can be see from FIG. 6, in particular, inlet and outlet opening 111, 112 and pump chamber 141 (each in respect of their middle as seen from the axial direction) are spaced apart from each other by a distance A.

Pump casing 140 is releasably connected at a connection point or interface 170 to transmission unit 150. One of the two shafts, in this case shaft 131, is guided out of the gearbox casing 152 and can be made to rotate by means of a drive motor (not shown). This rotation is transmitted to the other shaft (not shown) by the gear mechanism (not shown) in gearbox casing 152.

Shaft 131 is mounted rotatably in gearbox casing 152 and projects with a section 131*a* into pump chamber 141. Rotary lobe 121 is releasably and torque-resistantly fixed to section 131*a*. The second rotary lobe 122 is fixed in the same manner to the second shaft (not shown). Pump casing 140 does not have any bearings for the two shafts and can therefore be of integral construction. This results in a pump casing 140 which is particularly cost-efficient to produce, which can be cast without a core and which requires only only clamp when it is being treated or processed. The integral embodiment of pump casing 140 also reduces the number of casing separation points, so the precision with which the housing sections are fitted together can be advantageously enhanced.

A wear plate 160 is arranged between the pump casing 140 and transmission unit 150, said wear plate preferably being releasably fixed to transmission unit 150. Due to the inventive construction of rotary lobe pump 100, it is possible to provide just one single wear plate 160, as a result of which savings of time and money for maintenance can be achieved.

The fluid medium entering the connection casing through inlet connection member 115 and inlet opening 111 flows via a first flow channel 113 into pump chamber 141 and from there via a second flow channel 114 through outlet opening 112 and outlet connection member 116 out of rotary lobe pump 100. The two flow channels 113, 114 each have a first section 113*a*, 114*a* that runs inside transmission unit 150, and a second section 113*b*, 114*b* that runs inside pump casing 140. The two flow channels 113, 114 are arranged partially parallel to shaft 131, i.e., in a substantially axial direction of rotary lobe pump 100 in relation to axis 180 of rotary lobe pump 100. This produces a partially axial inflow and outflow of fluid medium into and out of pump chamber 141. Flow channel 113 is formed at least partially inside flow space 153, or forms part of flow space 153. The same applies to flow channel 114 and another flow space (not shown). Due to the at least partially axial inflow and outflow of the fluid medium through the flow spaces and channels, the axial distance A between inlet and outlet opening 111, 112 and pump chamber 141 is overcome.

The arrangement of inlet opening 111 and outlet opening 112 in the upper half of connection casing 151 during operation of the rotary lobe pump 100 results in excellent fluid feed at all times in rotary lobe pump 100 and in particular in pump chamber 141, especially in combination with the at least partially axial inflow and outflow of the fluid medium.

As can be seen from FIGS. 3, 4 and 8, connection casing 151 may have two releasably closable drain holes 154*a, b* with releasably attached cover plates 155*a, b*, through which the medium being conveyed can be drained. This facilitates maintenance of the rotary lobe pump, in that it permits complete or almost complete emptying of connection casing 151, in particular of the at least one flow space 153 formed between the connection casing and the gearbox casing, and of the flow channels 113, with the result that no medium to be conveyed continues to flow when the rotary lobe pump is opened for maintenance purposes, for example. During operation of rotary lobe pump 100, it is preferred that cover plates 155*a, b* close drain holes 154*a, b* tight in order to prevent any undesired prevent any undesired leakage of the medium being conveyed.

Additional advantages ensue from the inventive arrangement of inlet opening and outlet opening 111, 112 on connection casing 151 and from the arrangement of the two rotary lobes 121, 122 in pump casing 140. It is possible, firstly, to connect rotary lobe pump 100 rigidly to connection casing 151 in a piping system (not shown) via the connection members 115, 116 which adjoin inlet opening and outlet opening 111, 112 and which are provided with connection flanges 117, 118. Despite this rigid connection of connection casing 151, it is nevertheless possible at the same time for the wearing parts, in particular wear plate 160 and rotary lobes 121, 122, to be replaced easily and quickly by removing pump casing 140. It is also possible in this way to attach rotary lobes with other sizes and pump casings with other sizes to the shafts and to transmission unit 150, and hence to modify the size and capacity of rotary lobe pump 100 simply and quickly with a construction kit for such a rotary lobe pump. It is preferred in this regard that the respective connections and attachment mechanisms of the transmission unit and the shafts, on the one hand, and the rotary lobes and pump casings of different sizes, on the other hand, be designed in such a way that different combinations can be realized with the same connections and attachment mechanisms.

On the whole, the structure of inventive rotary lobe pump 100 has little dead space in which solids can be deposited.

The invention claimed is:

1. A rotary lobe pump for conveying a fluid medium containing solids, comprising a pump casing comprising a pump chamber formed inside the pump casing;

a connection casing with a gearbox casing arranged at least partially inside the connection casing to comprise an integral transmission unit;

wherein the pump casing and the transmission unit are releasably connected to each another;

an inlet opening and an outlet opening for the medium being conveyed, wherein the inlet opening and the outlet opening are arranged on the connection casing, and are generally aligned at a same axial position with the gearbox casing, two rotary lobes arranged in the pump chamber and having rotary lobe vanes engaging with each other, wherein each of the two rotary lobes is fixed torque-resistantly on a respective shaft and can be driven by said respective shaft, and wherein the respective shafts are coupled to each other by a transmission gear arranged in the gearbox casing of the transmission unit, wherein a first flow channel is provided connecting the inlet opening to the pump chamber and a second flow channel is provided connecting the outlet opening to the pump chamber.

2. The rotary lobe pump according to claim 1, characterized in that the two rotary lobes are releasably fixed to the respective shaft.

3. The rotary lobe pump according to claim 1, further comprising a wear plate arranged between the pump casing and the transmission unit, said wear plate being releasably fixed to the transmission unit.

4. The rotary lobe pump according to claim 1, characterized in that the rotary lobe pump has only one wear plate.

5. The rotary lobe pump according to claim 1, characterized in that the pump casing has no bearing for the two shafts.

6. The rotary lobe pump according to claim 1, characterized in that the pump casing is of integral construction.

7. The rotary lobe pump according to claim 1, wherein at least one part of the first and second flow channels runs in a substantially axial direction parallel to the shafts.

8. The rotary lobe pump according to claim 1, characterized in that the inlet opening and the outlet opening are arranged in the upper half of the connection casing during operation of the rotary lobe pump.

9. The rotary lobe pump according to claim 1, characterized in that the inlet opening and the outlet opening are arranged on the connection casing during operation of the rotary lobe pump in such a way that a first axis at right angles to a plane encompassing the inlet opening, and a second axis at right angles to a plane encompassing the outlet opening are each inclined at an angle of 45° from the vertical.

10. The rotary lobe pump according to claim 1, further comprising an inlet connection member which is attached to the inlet opening and includes an inlet flange, and an outlet connection member which is attached to the outlet opening and includes an outlet flange, wherein the inlet connection member and the outlet connection member are designed and attachable to the connection casing in such a way that the inlet flange, the outlet flange or both are arranged horizontally in a first fixing position and that the inlet flange, the outlet flange or both are arranged vertically in a second fixing position during operation of the rotary lobe pump.

11. The rotary lobe pump according to claim 1, characterized in that the connection casing includes at least one releasably closable drain hole through which the medium being conveyed can be drained.

12. The rotary lobe pump according to claim 1, wherein the inlet opening is coupled to an inlet flange, wherein the outlet opening is coupled to an outlet flange, and wherein the inlet flange, the outlet flange, and the transmission gear are arranged with substantially no axial distance therebetween.

13. A construction kit for a rotary lobe pump, for providing rotary lobe pumps of different size and/or capacity, comprising the rotary lobe pump according to claim 1 and further comprising at least two additional rotary lobes of a different size and having rotary lobe vanes engaging with each other, wherein the two shafts and the at least two additional rotary lobes of a different size are designed in such a way that the at least two additional rotary lobes of a different size are each releasably attachable to the respective one of the two shafts.

14. The construction kit for a rotary lobe pump according to claim 13, characterized by at least one additional pump casing of a different size, wherein the transmission unit and the at least one additional pump casing of a different size are designed in such a way that the at least one additional pump casing of different size is releasably attachable to the transmission unit.

* * * * *